US005414396A

United States Patent [19]

Bagalini

[11] Patent Number: 5,414,396

[45] Date of Patent: May 9, 1995

[54] SHUNT TRIP DEVICE

[75] Inventor: Dante Bagalini, Johannesburg, South Africa

[73] Assignee: Circuit Breaker Industries Limited, Johannesburg, South Africa

[21] Appl. No.: 120,667

[22] Filed: Sep. 13, 1993

[30] Foreign Application Priority Data

Sep. 14, 1992 [ZA] South Africa ..... 92/7004

[51] Int. Cl.[6] ..... H01H 9/00

[52] U.S. Cl. ..... 335/179; 335/177

[58] Field of Search ..... 335/167–172, 335/177, 178, 179

[56] References Cited

U.S. PATENT DOCUMENTS

| | | | |
|---|---|---|---|
| 3,614,689 | 10/1971 | Canonne | 335/229 |
| 4,808,952 | 2/1989 | Berner et al. | 335/119 |
| 4,931,758 | 6/1990 | Bagalini | 335/177 |
| 5,006,826 | 4/1991 | Knoben et al. | 335/35 |

*Primary Examiner*—Lincoln Donovan
*Attorney, Agent, or Firm*—Ladas & Parry

[57] ABSTRACT

A shunt trip device includes an armature 18 pivotally mounted on a frame 12 of a ferro-magnetic material. A "U"-shaped member 20 is mounted on the frame 12 via a spacer 30 of a non-magnetic material. The member 20 and a portion of a post 16 of the frame 12 and the armature 18 define a first magnetic circuit. A limb 22 and a bridge portion 26 of the member 20 together with a part 14.1 and the post 16 of the frame and the armature 18 define a second magnetic circuit. A limb 24 and the bridge 26 of the member 20 together with the part 14.1 and the post 16 of the frame 12 and that portion of the armature 18 between the post 16 and the limb 24 define a third magnetic circuit. A coil 34 is carried on the limb 22 of the member 20 and permanent magnetic 22 is sandwiched between the portion 26 of the member 20 and the part 14.1 of the frame 12.

12 Claims, 2 Drawing Sheets

SHUNT TRIP DEVICE

FIELD OF THE INVENTION

This invention relates to a shunt trip device.

SUMMARY OF THE INVENTION

According to the invention there is provided a shunt trip device that is responsive to a trip current which includes an armature which is displaceable between a first, closed position and a second, open position;

an urging means for urging the armature from its first position to it second position;

a frame which includes a support on which the armature is pivotally mounted, the frame being of a ferromagnetic material;

a first magnetic circuit defining means which defines a first magnetic circuit together with the armature and which includes a pole piece defining member, with the armature being in contact with the pole piece defining member when it is in its first position and being spaced from the pole piece defining member when it is in its second position;

a first magnetic field generating means for generating magnetic flux in the first magnetic path;

a second magnetic circuit defining means for defining a second magnetic circuit together with the pole piece defining member and the support;

a third magnetic circuit defining means for defining a third magnetic circuit together with the support and which does not pass through the pole piece defining member; and a second magnetic field generating means for generating magnetic flux in the second and third magnetic circuits.

A spacer member may be provided in the third magnetic circuit for varying the reluctance of the circuit in a predetermined manner.

The first magnetic circuit defining means may have an air gap between a portion thereof and the armature.

The first magnetic field generating means may be a coil through which the trip current flows.

The second magnetic field generating means may be a permanent magnet.

Conveniently, the first magnetic circuit defining means may include a "U"-shaped ferromagnetic member, one of the legs thereof defining the pole piece and the coil being located about this leg.

The support may be a post on which the armature is pivotally mounted, the free leg of the "U"-shaped member being secured to the post by means of the spacer.

The frame may also have a base from which the post extends. The permanent magnet may then be located between the base and a bridge portion of the "U"-shaped member.

It will be appreciated that the polarity of the coil is such as to oppose the flux provided by the permanent magnet.

Finally, the urging means may comprise a helical spring which is under tension and which is connected to the armature on the other side of the post to the pole piece.

In use, the armature is displaced so that it engages the pole piece. The flux set up by the permanent magnet in the second magnetic circuit is sufficient, when there is no current in the coil, to keep the armature in contact with the pole piece. When sufficient current flows through the coil, some of the flux of the second magnetic circuit is transferred to the third magnetic circuit so that the spring displaces the armature, thereby activating a tripping mechanism. The armature is re-set, by means of a reset mechanism, back into engagement with the pole piece.

By varying the air gap between the free limb of the "U"-shaped member and the thickness of the spacer, the characteristics of the shunt trip device may be varied as desired.

BRIEF DESCRIPTION OF THE DRAWINGS

The invention is now described, by way of an example, with reference to the accompanying drawings, in which.

DETAILED DESCRIPTION OF THE DRAWINGS

Figure 1:
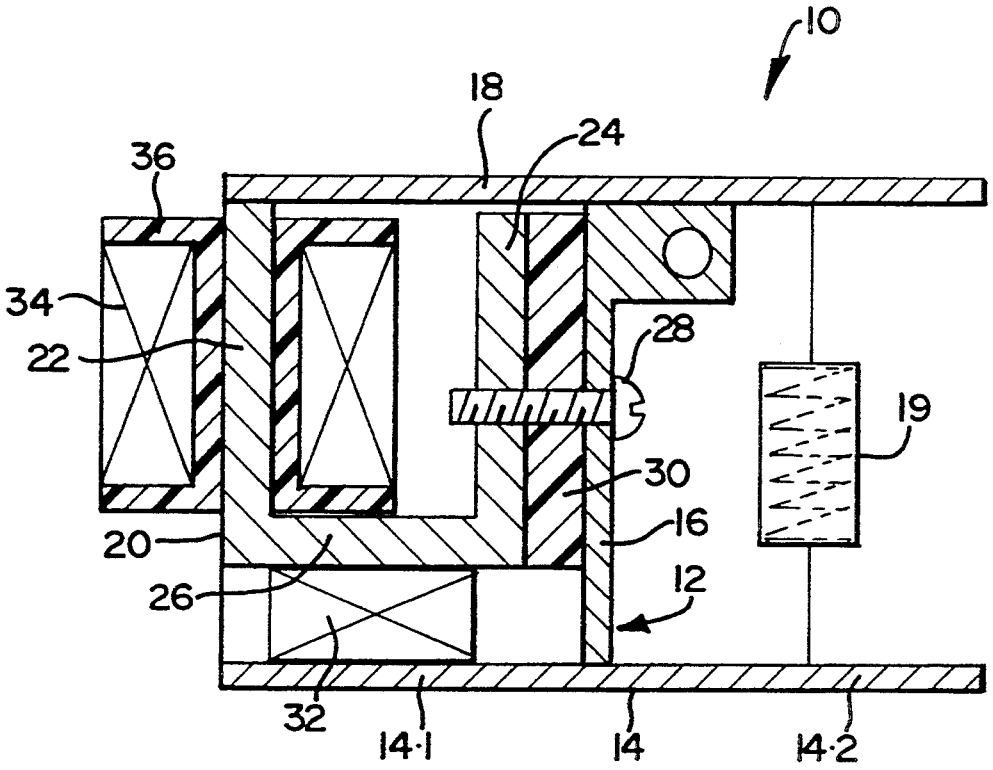
FIG. 1 shows a schematic sectioned view of an electro-magnetic unit of a low energy shunt trip device in accordance with the invention.
Figure 2:
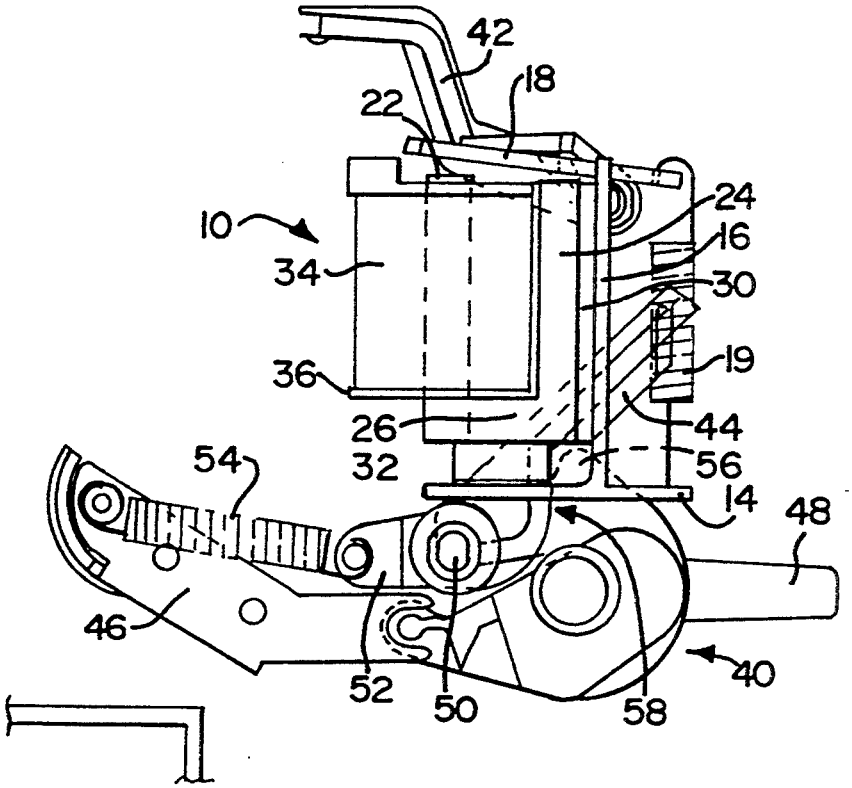
FIG. 2 shows schematically the electro-magnetic unit together with a tripping mechanism in its "tripped" configuration.
Figure 3:
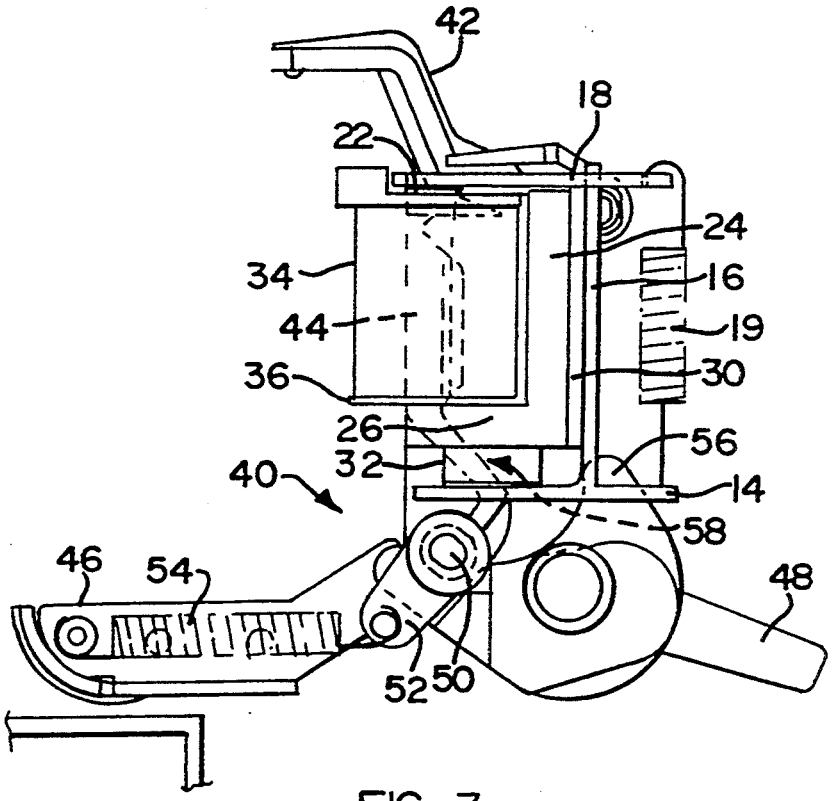
FIG. 3 shows schematically the tripping mechanism in its "on" configuration.

Referring to FIG. 1, an electro-magnetic unit of a low energy shunt trip device is designated generally by reference numeral 10. The unit 10 has a mild steel frame 12 which has a base 14 and a post 16 extending upwardly therefrom. The post 16 is centrally located so that the base 14 has a left hand portion 14.1 and a right hand portion 14.2. A mild steel armature 18 is pivotally mounted on the post 16. A spring 19 is interconnected between the right hand portion of the base 14.2 and the armature 18. The spring 19 is under tension so that it pulls the right hand side of the armature 18 down towards the base 14, thereby tending to pivot the armature 18 in a clockwise direction. Pivoting of the armature 18 in a clockwise direction is limited by means of a tripping mechanism and a reset mechanism, which are not shown in FIG. 1. The tripping mechanism is indicated in FIGS. 2 and 3 and is discussed below.

The unit 10 further has a mild steel "U"-shaped member 20. The member 20 has a left hand limb 22, a right hand limb 24 and a bridge portion 26. The right hand limb 24 is secured to the post 16, on the other side thereof to the spring 19, by means of a screw 28. A spacer 30, that is of a non-magnetic material, is provided between the limb 24 and the post 16. It will be seen that the limb 22 is slightly longer than the limb 24. The free end of the limb 22 is aligned with the top of the post 16 and the armature 18 contacts the free end of the limb 22 when pivoted in an anti-clockwise direction against the spring 19. When the armature 18 is in contact with the free end of the limb 22 there is an air gap of about 0,5 mm between the armature 18 and the free end of the limb 24.

A permanent magnet 32 is gripped between the bridge portion 26 and the left hand portion 14.1 of the base 14.

A coil 34 which is wound on a bobbin 36 is provided on the limb 22.

It will be appreciated that the limb 22 constitutes a pole piece. It will further be appreciated that the "U"-shaped member 20 together with that portion of the post 16 adjacent the limb 24 and the armature 18 defines a first magnetic circuit, with most of the flux therein passing through the air gap between the limb 24 and the armature 18, as this gap is very much smaller than the thickness of the spacer 30. Further, the limb 22, the bridge portion 26, the left hand part 14.1 of the base 14, the post 16 and the armature 18 define a second magnetic circuit. Finally, the limb 24, the bridge portion 26, the left hand base portion 14.1 and the post 16 and that portion of the armature 18 between the post 16 and the limb 24 define a third magnetic circuit, with flux also passing through the spacer 30.

In use, the coil 34 generates flux in the first and second magnetic circuits and the permanent magnet 32 provides flux in the second and third magnetic circuits.

In use, in normal operation there is no current in the coil 34. The flux provided by the permanent magnet 32 in the second magnetic circuit causes the armature 18 to be held in contact with the limb 22, when displaced thereagainst by the reset mechanism (not shown) against the spring 19. The flux is not strong enough to close the armature 18 on its own. When a relatively small current flows through the coil 34, some of the flux is transferred from the second magnetic circuit to the third magnetic circuit and the force holding the armature 18 to the limb 22 decreases and the armature 18 is pivoted in a clockwise manner by the spring 19, thereby operating the tripping mechanism (shown in FIGS. 2 and 3) of the device 10.

The applicant believes that with a unit as shown in the drawing, a 6 V, 1 mA trip current will be sufficient to trip the device.

Further, as indicated above, the holding force of the unit may be varied by varying the thickness of the spacer 30 and the magnitude of the trip current may easily be varied by varying the air gap between the limb 24 and the armature 18.

Referring now to FIGS. 2 and 3, the unit 10 is shown together with a tripping mechanism 40, which is shown schematically. The tripping mechanism 40 is shown in a "tripped" configuration in FIG. 2 and an "on" configuration in FIG. 3.

The tripping mechanism 40 has a trip lever 42, which is connected to the armature 18, a cradle 44, a moving contact carrier 46 and a handle 48. The cradle 44 is pivotal about a pin 50 and has an extension arm 52. A tension spring 54 is connected between the arm 52 and carrier 46 in an "over-centre" manner. The handle 48 has a nose 56 which engages and rides along an angled surface 58 on the cradle 44 to pivot it into engagement with the trip lever 42 when the armature 18 and trip lever 42 are in their "on" positions. The mechanism whereby the armature 18 and trip lever 42 are reset and pivoted into their "on" positions, as discussed above, is not shown.

It will be readily understood by person skilled in the art that, when the armature 18 pivots away from the limb 22, the trip lever 42 also pivots, thereby releasing the cradle 44. The cradle 44 and carrier then pivot from their "on" positions shown in FIG. 3 to their "tripped" positions shown in FIG. 2.

By means of the invention a shunt trip device is provided which is operable by a shunt current having an extremely low energy and the characteristics of the device may be varied in a simple and repeatable manner.

I claim:

1. A shunt trip device that is responsive to a trip current which includes an armature which is displaceable between a first, closed position and a second, open position;

an urging means for urging the armature from its first position to it second position;

a frame which includes a support on which the armature is pivotally mounted, the frame being of a ferro-magnetic material;

a first magnetic circuit defining means which defines a first magnetic circuit together with the armature and which includes a pole piece defining member, with the armature being in contact with the pole piece defining member when it is in its first position and being spaced from the pole piece defining member when it is in its second position;

a first magnetic field generating means for generating magnetic flux in the first magnetic path;

a second magnetic circuit defining means for defining a second magnetic circuit together with the pole piece defining member and the support;

a third magnetic circuit defining means for defining a third magnetic circuit together with the support and which does not pass through the pole piece defining member; and a second magnetic field generating means for generating magnetic flux in the second and third magnetic circuits.

2. The device as claimed in claim 1, in which the third magnetic circuit defining means includes a spacer that is of a non-magnetic material.

3. The device as claimed in claim 1, in which the first magnetic circuit defining means includes an air gap.

4. The device as claimed in claim 3, in which the air gap is provided between the armature and an element forming part of the first magnetic circuit defining means.

5. The device as claimed in claim 1, in which the first magnetic field generating means comprises a coil.

6. The device as claimed in claim 1, in which the second magnetic field generating means comprises a permanent magnet.

7. The device as claimed in claim 1, in which the first magnetic circuit defining means includes a "U"-shaped member, one of the legs thereof constituting the pole piece defining member.

8. The device as claimed in claim 7, in which the support is a post and one leg of the "U"-shaped member is secured thereto.

9. The device as claimed in claim 8, in which the frame has a base from which the support extends, and the second magnetic field generating means is located between a bridge portion of the "U"-shaped member and the frame.

10. The device as claimed in claim 7, in which the leg that constitutes the pole piece defining member is slightly longer than the other leg.

11. The device as claimed in claim 1, in which flux generated by the first magnetic field generating means also passes through the second magnetic circuit.

12. The device as claimed in claim 1, in which the urging means is a spring.

* * * * *